US012624878B2

(12) United States Patent
Winckler et al.

(10) Patent No.: US 12,624,878 B2
(45) Date of Patent: May 12, 2026

(54) RESERVOIR ACCESS FOR STAND-ALONE ICE MAKING APPLIANCE

(71) Applicant: Haier US Appliance Solutions, Inc., Wilmington, DE (US)

(72) Inventors: Rachel Winckler, Louisville, KY (US); Samuel Vincent DuPlessis, Louisville, KY (US); Minjoo Annie Han, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 187 days.

(21) Appl. No.: 18/467,868

(22) Filed: Sep. 15, 2023

(65) Prior Publication Data

US 2025/0093085 A1 Mar. 20, 2025

(51) Int. Cl.
*F25C 1/25* (2018.01)
*F25C 1/147* (2018.01)

(52) U.S. Cl.
CPC ..... *F25C 1/25* (2018.01); *F25C 1/147* (2013.01); *F25C 2400/14* (2013.01); *F25C 2700/04* (2013.01)

(58) Field of Classification Search
CPC ..... F25C 1/25; F25C 1/147; F25C 2400/14; F25C 2700/04
USPC ..... 62/354
See application file for complete search history.

(56) References Cited

U.S. PATENT DOCUMENTS 2,877,318 A * 3/1959 Culley ..... G01F 23/36 200/84 R
3,686,890 A * 8/1972 Lyman ..... F25C 5/142 62/348
4,884,692 A * 12/1989 Middlebrooks .... G11B 33/0438 53/472
5,431,177 A * 7/1995 Kecman ..... A45C 11/00 D28/78
5,921,103 A 7/1999 Hilsinger
2007/0214809 A1* 9/2007 DiLorenzo ..... F25C 1/18 62/340
2010/0147008 A1 6/2010 Watson et al.
2018/0010837 A1* 1/2018 Miller ..... F25C 5/182

FOREIGN PATENT DOCUMENTS

CN 111174476 A 5/2020
CN 212383204 U 1/2021
CN 215675961 U 1/2022
JP H05333516 A * 12/1993
JP H-0966998 A * 3/1997
JP 4794941 B2 10/2011

OTHER PUBLICATIONS

JPH 0966998 A, machine translation (Year: 2025).*
JP H05333516 A, machine translation (Year: 2025).*

* cited by examiner

*Primary Examiner* — Len Tran
*Assistant Examiner* — Kirstin U Oswald
(74) *Attorney, Agent, or Firm* — Dority & Manning, P.A.

(57) ABSTRACT

An ice making appliance includes a casing, a user interface on the casing, a container within the casing, and a reservoir disposed within the casing. The reservoir includes an internal lid. The stand-alone ice making appliance also includes a cover disposed on an external surface of the casing. The cover is rotatable over the reservoir. The internal lid of the reservoir is coupled to the cover. A hinge rotatably couples the cover to the external surface of the casing over the reservoir.

16 Claims, 4 Drawing Sheets

RESERVOIR ACCESS FOR STAND-ALONE ICE MAKING APPLIANCE

FIELD OF THE INVENTION

The present subject matter relates generally to ice making appliances, and more particularly to components of ice making appliances that produce nugget ice.

BACKGROUND OF THE INVENTION

Stand-alone ice making appliances are separate appliances from refrigerator appliances and provide independent ice supplies. Generally, liquid water is added to the stand-alone ice making appliance, and the ice maker operates to freeze the liquid water and form ice. In current ice making appliances, access for the user to add liquid water to the ice making appliance can be difficult. Some ice making appliances involve multiple steps to add water to the reservoir, such as dismantling portions of the ice making appliance in order to access the reservoir, which has to be removed and put back once full of water.

Accordingly, improved stand-alone ice making appliances are desired in the art. In particular, stand-alone ice making appliances that make access for the user to add liquid water easier for the user would be advantageous.

BRIEF DESCRIPTION OF THE INVENTION

Aspects and advantages of the invention will be set forth in part in the following description, or may be obvious from the description, or may be learned through practice of the invention.

In one example embodiment, a stand-alone ice making appliance includes a casing, a user interface on the casing, a container within the casing, and a reservoir disposed within the casing. The reservoir includes an internal lid. The stand-alone ice making appliance also includes a cover disposed on an external surface of the casing. The cover is rotatable over the reservoir. The internal lid of the reservoir is coupled to the cover. A hinge rotatably couples the cover to the external surface of the casing over the reservoir. The stand-alone ice making appliance further includes an ice maker disposed within the casing, and a pump disposed within the casing. The pump is in fluid communication with the reservoir and the ice maker. The pump is operable to flow water from the reservoir to the ice maker.

In another example embodiment, an ice making appliance includes a casing, a user interface on the casing, a container within the casing, and a reservoir disposed within the casing. The reservoir includes an internal lid. The stand-alone ice making appliance also includes a cover disposed on an external surface of the casing. The cover is rotatable over the reservoir. The internal lid of the reservoir is coupled to the cover. A hinge rotatably couples the cover to the external surface of the casing over the reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
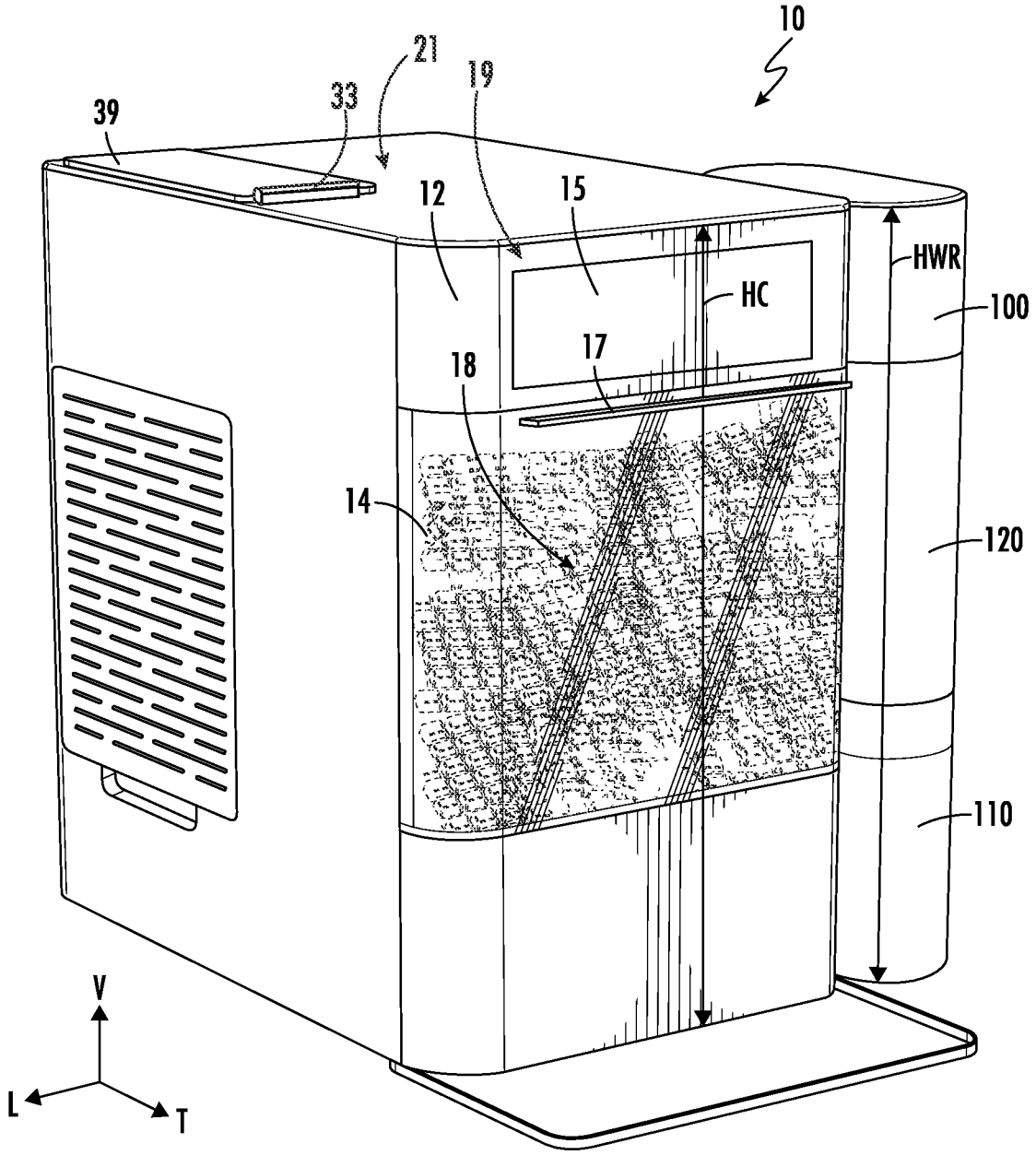
FIG. 1 is a perspective view of an appliance according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
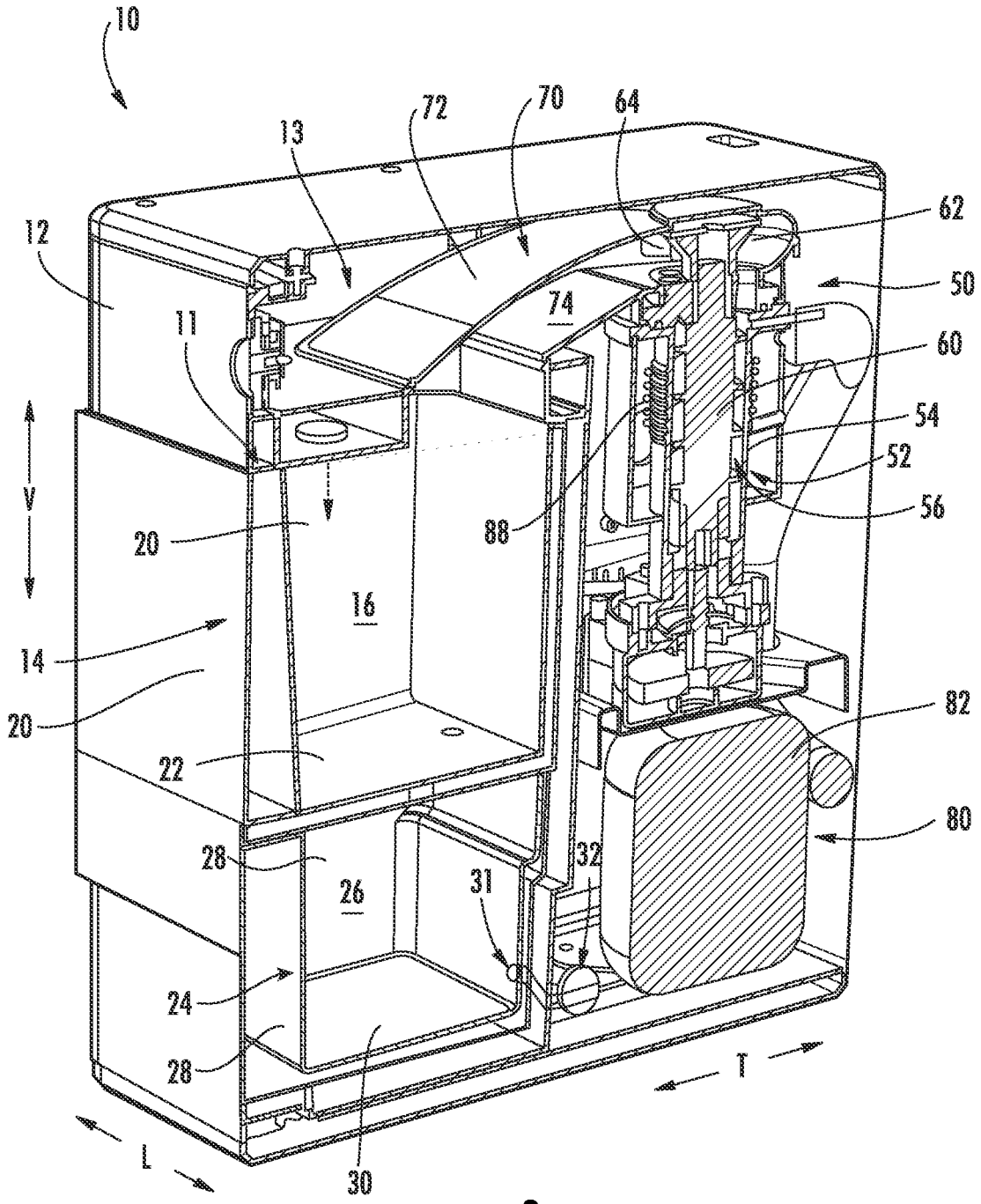
FIG. 2 is a perspective section view of the example appliance of FIG. 1.
Figure 3:
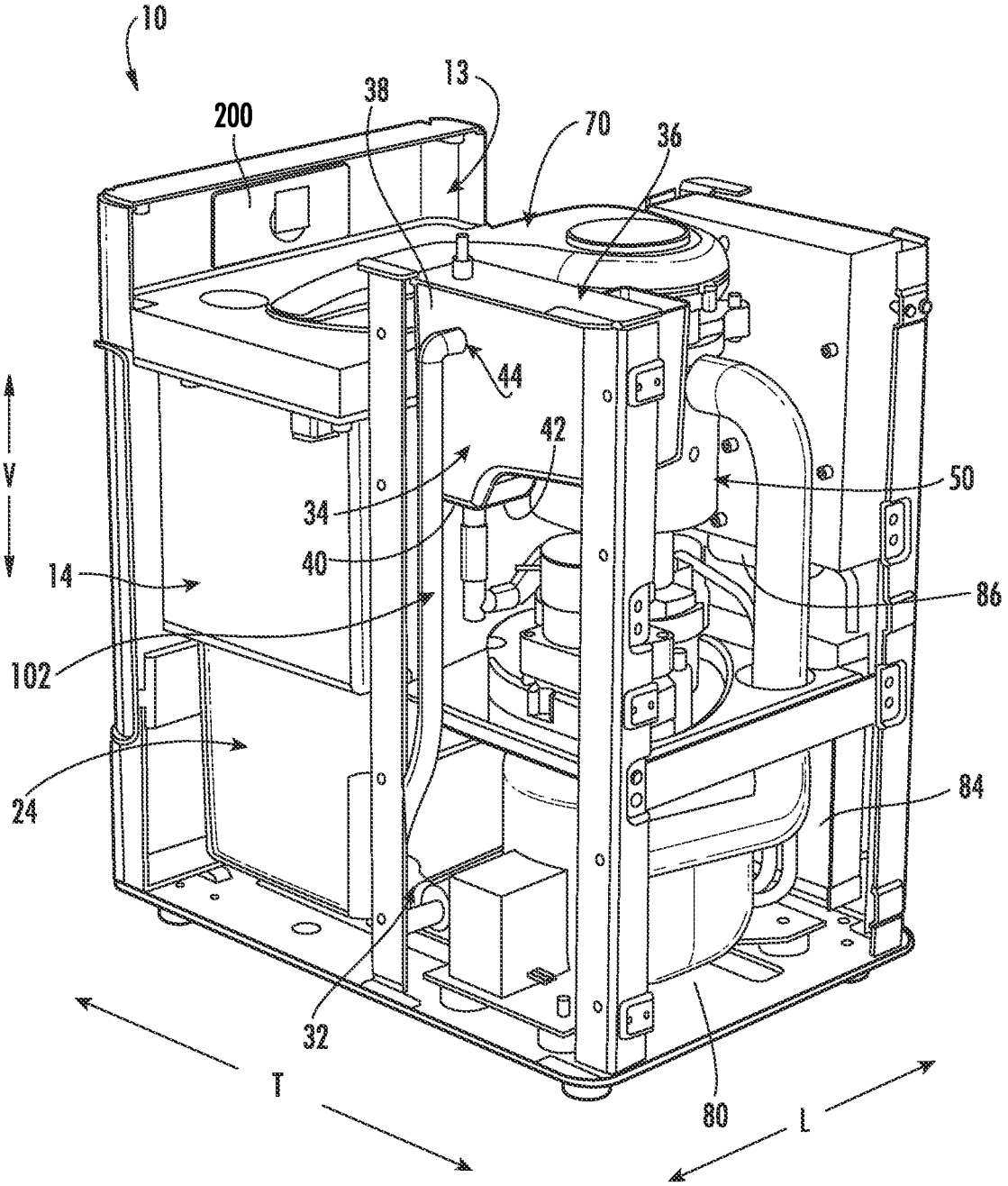
FIG. 3 is a rear perspective view of the example appliance of FIG. 1 with a casing of the example appliance removed to show interior components of the example appliance.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13 at a front side 19 of outer casing 12. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In example embodiments, at least one sidewall 20 may be formed in part from a clear, see-through (i.e., transparent, or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent, or translucent) material, such as a clear glass or plastic. In some example embodiments, container 14 may include a handle 17. In general, handle 17 may advantageously improve accessibility to ice 18 within container 14. Further, in example embodiments, container 14 may be removable, such as from the outer casing 12, by a user. This facilitates advantageous easy access by the user to ice within the container 14, as discussed below. In general, a user interface 15 may be positioned on casing 12 above container 14 at front side 19 of casing 12. The user interface 15 may generally include input selectors to be selected (e.g., by a user) for controlling the appliance 10.

Appliances 10 in accordance with the present disclosure are advantageously stand-alone appliances, and thus are not connected to refrigerators or other appliances. Additionally, in example embodiments, such appliances are not connected to plumbing or another water source that is external to the appliance 10, such as a refrigerator water source. Rather, in example embodiments, water is initially supplied to the appliance 10 manually by a user, such as by pouring water into water tank 24 and/or an auxiliary reservoir 100. Optionally, in example embodiments, water tank 24 may be removable, such as from the outer casing 12, by a user. This facilitates advantageous easy access by the user to water tank 24 (e.g., in order to easily fill water tank 24), as discussed below.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In example embodiments, such as those shown in FIGS. 1 through 3, the removable container 14 allows easy access to ice 18 within first storage volume 16 and allows the container 14 to be moved to a different position from the remainder of the appliance 10 for ice usage purposes.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit, but generally no greater than room temperature, e.g., seventy-two degrees Fahrenheit.

Still referring to FIGS. 1 through 3, various components of appliance 10 in accordance with the present disclosure are illustrated. For example, as mentioned, appliance 10 includes a water tank 24. The water tank 24 defines a second storage volume 26 for the receipt and holding of water. Water tank 24 may include multiple walls, including one or more sidewalls 28 and a base wall 30, which may together define the second storage volume 26. In example embodiments, the water tank 24 may be disposed below the container 14 along the vertical direction V defined for the appliance 10, as shown.

As discussed, in example embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, be operable to actively flow water from the second storage volume 26 therethrough and from the pump 32.

Figure 4:
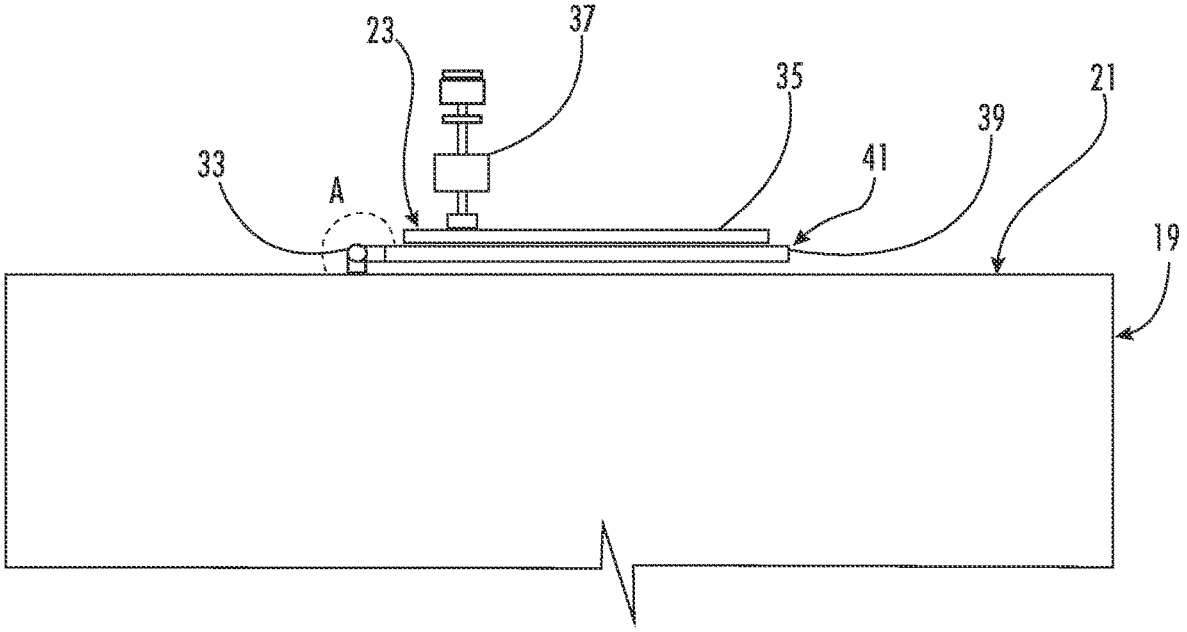
FIG. 4 is a side schematic view of the example appliance of FIG. 1.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34. Referring briefly to FIG. 4, provided is a side schematic view of reservoir 34. Reservoir 34 may generally include a cover 39 encasing reservoir 34 within casing 12. In some example embodiments, reservoir may include an internal lid 35 to seal the reservoir 34 within casing 12. Internal lid 35 may include a float sensor 37 for monitoring the water level inside of reservoir 34. Cover 39 will be described in further detail herein.

Referring again to FIGS. 1 through 3, reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In example embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in example embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provided to the container 14. In example embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In example embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

It should additionally be noted that, in example embodiments, a controller 200 may be in operative communication with the sealed system 80, such as with the compressor 82 thereof, and may activate the sealed system 80 as desired or required for ice making purposes.

In example embodiments, controller 200 is in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which indicate whether or not additional water is desired in the reservoir 34. When controller 200 receives a signal that water is desired, controller 200 may send a signal to pump 32 to activate pump 32.

As shown in FIG. 1, appliance 10 may also include an auxiliary water reservoir 100. As may be seen, a height HWR of auxiliary water reservoir 100 may be about equal to a height HC of casing 12. Thus, the appearance of auxiliary water reservoir 100 may complement casing 12.

Auxiliary water reservoir 100 may be disposed outside of casing 12. For example, auxiliary water reservoir 100 may be mounted at the side of casing 12. Thus, while most components of appliance 10 are housed within casing 12, auxiliary water reservoir 100 is positioned outside of casing 12. In certain example embodiments, auxiliary water reservoir 100 may include a base 110 and a container 120. Base 110 may be attached to casing 12, e.g., at the side of casing 12 adjacent to the bottom of casing 12. For instance, base 110 may be clipped, fastened, etc. to casing 12. Container 120 may be removably mounted to base 110.

Auxiliary water reservoir 100 may be in fluid communication with a water tank within casing 12 such that water within auxiliary water reservoir 100 is flowable to the water tank. For example, a flexible tubing conduit, or a supply line 102, may extend from auxiliary water reservoir 100 to water tank 24, and water from within auxiliary water reservoir 100 may flow from auxiliary water reservoir 100 into second storage volume 26 via supply line 102. It will be understood that appliance 10 may be plumbed in any other suitable manner to deliver water from auxiliary water reservoir 100 into casing 12 for use with ice maker 50 in alternative example embodiments.

Referring now to FIG. 4, cover 39 may be disposed on an external surface 21 of casing 12. In some example embodiments, cover 39 may be rotatable over reservoir 34 with the internal lid 35 of the reservoir 34 coupled to cover 39. In general, a hinge 33 may rotatably couple cover 39 to the external surface 21 of casing 12 over reservoir 34. In other words, hinge 33 may be generally positioned between a distal end 41 of cover 39 and the front side 19 of appliance 10. Generally, FIG. 1 illustrates cover 39 in a closed position, and FIG. 4 generally illustrates cover 39 rotated about hinge 33, along an angle A, in the open position. When cover 39 is in the closed position (e.g., FIG. 1) float sensor 37 may extend downward into reservoir 34, whereas when cover 39 is in the open position (e.g., FIG. 4) the float sensor rests upside-down, extending upwards away from the external surface 21 of casing 12.

In some example embodiments, float sensor 37 may be disposed at an inside portion 23 of internal lid 35. For example, inside portion 23 may be proximate hinge 33, whereby float sensor 37 may be positioned proximate hinge 33 on internal lid 35. Furthermore, internal lid 35 of reservoir 34 may be coupled to cover 39, e.g., internal lid 35 may be positioned within or fastened to cover 39. In general, float sensor 37 may include an electrical connection (not shown), whereby the electrical connection is disposed between internal lid 35 and cover 39, which may advantageously limit access to the electrical connection. As such, rotating cover 39 about hinge 33 may simultaneously rotate internal lid 35 of reservoir 34, and thereby float sensor 37 coupled to internal lid 35 may also rotate from within reservoir 34. In particular, cover 39 may be rotated angle A degrees about hinge 33, e.g., angle A may be no less than of one hundred and sixty degrees (160°), or no less than one hundred and seventy degrees (170°), or no less than one hundred and eighty degrees (180°), but generally no more than two hundred degrees (200°). For example, cover 39 may rotate one hundred and eighty degrees (180°) about hinge 33 towards a front side 19 of appliance 10. In particular, rotating cover 39 about hinge 33 away from reservoir 34, exposes an interior volume, i.e., third storage volume 36 of reservoir 34 such that third storage volume 36 of reservoir 34 may be advantageously exposed and accessible to the user. In particular, increased access to reservoir 34 may advantageously allow the user access to fill and/or clean reservoir 34.

Moreover, one of skill in the art would understand the appliance 10 described herein is by way of example only. Particularly, the present disclosure may be used with any suitable ice making appliance, i.e., ice making appliance 10 may be any stand-alone ice making appliance, such as any countertop ice making appliance having a reservoir for holding water. For example, the nugget ice making system, e.g., including the auger and the cylinder, is provided by way of example only and aspects of the present disclosure may also be used with other ice makers such as clear ice makers or ice makers including a mold body, e.g., which form ice cubes, among other possible variations in the ice making appliance according to the present disclosure.

As may be seen from the above, the present disclosure may advantageously include an upper reservoir in an ice making appliance that includes an access lid with a hinge. The access lid may be added on the top of the ice making appliance in order to access the reservoir. A float sensor may be placed at bottom of the access lid. The access lid of the ice making appliance may be rotated to open towards the consumer (e.g., the front of the ice making appliance) and rest upside down in a stationary position. The electricals for the float sensor may be advantageously hidden under the access lid, and the double layer lid may prevent the consumer from being able to touch the float sensor connection point. The hinge may rotate specifically such that the float sensor has plenty of room to rotate without needing to be fully removed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:

a casing;

a user interface on the casing;

a container within the casing;

a reservoir disposed within the casing, the reservoir comprising an internal lid;

a cover disposed on an external surface of the casing, the cover rotatable over the reservoir, the internal lid of the reservoir coupled to the cover;

a hinge rotatably coupling the cover to the external surface of the casing over the reservoir, whereby the cover is rotatable between an open position and a closed position, wherein the hinge extends from the external surface of the casing, whereby the hinge is outside of the casing;

a float sensor coupled to the internal lid of the reservoir, whereby the float sensor extends downward into the reservoir perpendicular to the internal lid when the cover is in the closed position;

an ice maker disposed within the casing; and a pump disposed within the casing, the pump in fluid communication with the reservoir and the ice maker, the pump operable to flow water from the reservoir to the ice maker, wherein the internal lid of the reservoir is coupled to the cover, whereby rotating the cover about the hinge simultaneously rotates the internal lid of the reservoir and the float sensor coupled to the internal lid, wherein, when the cover is in the open position, the float sensor rests upside-down, extending perpendicularly upwards away from the external surface of the casing, whereby operation of the pump is ceased when the float sensor rests upside-down, and wherein the cover rotates about the hinge outside of the casing, whereby the simultaneous rotation of the cover and the float sensor coupled to the internal lid of the cover positions the float sensor outside of the casing, whereby an interior volume of the reservoir is unobstructed.

2. The stand-alone ice making appliance of claim 1, further comprising a flexible tubing conduit, the flexible tubing conduit extending from the reservoir to the ice maker.

3. The stand-alone ice making appliance of claim 1, wherein the float sensor is disposed at an inside portion of the internal lid, the inside portion proximate the hinge.

4. The stand-alone ice making appliance of claim 1, wherein the float sensor comprises an electrical connection, wherein the electrical connection is disposed between the internal lid and the cover, whereby access to the electrical connection is limited.

5. The stand-alone ice making appliance of claim 1, wherein the cover may be rotated no less than an angle of one hundred and eighty degrees about the hinge.

6. The stand-alone ice making appliance of claim 1, wherein the cover rotates about the hinge towards a front side of the ice making appliance, whereby the hinge is positioned between a distal end of the cover and the front side of the stand-alone ice making appliance.

7. The stand-alone ice making appliance of claim 1, wherein, when the cover is rotated about the hinge away from the reservoir, the interior volume of the reservoir is exposed and accessible.

8. The stand-alone ice making appliance of claim 1, wherein an auger disposed in the ice maker, the auger configured to lift partially frozen water through the ice maker.

9. An ice making appliance, comprising:

a casing;

a user interface on the casing;

a container within the casing;

a reservoir disposed within the casing, the reservoir comprising an internal lid;

a cover disposed on an external surface of the casing, the cover rotatable over the reservoir, the internal lid of the reservoir coupled to the cover;

a hinge rotatably coupling the cover to the external surface of the casing over the reservoir, whereby the cover is rotatable between an open position and a closed position, wherein the hinge extends from the external surface of the casing, whereby the hinge is outside of the casing;

a float sensor coupled to the internal lid of the reservoir, whereby the float sensor extends downward into the reservoir perpendicular to the internal lid when the cover is in the closed position; and a pump disposed within the casing, the pump in fluid communication with the reservoir, wherein the internal lid of the reservoir is coupled to the cover, whereby rotating the cover about the hinge simultaneously rotates the internal lid of the reservoir and the float sensor coupled to the internal lid, wherein, when the cover is in the open position, the float sensor rests upside-down, extending perpendicularly upwards away from the external surface of the casing, whereby operation of the pump is ceased when the float sensor rests upside-down, and wherein the cover rotates about the hinge outside of the casing, whereby the simultaneous rotation of the cover and the float sensor coupled to the internal lid of the cover positions the float sensor outside of the casing, whereby an interior volume of the reservoir is unobstructed.

10. The ice making appliance of claim 9, further comprising a flexible tubing conduit, the flexible tubing conduit extending from the reservoir to an ice maker of the ice making appliance.

11. The ice making appliance of claim 10, wherein an auger disposed in the ice maker, the auger configured to lift partially frozen water through the ice maker.

12. The ice making appliance of claim 9, wherein the float sensor is disposed at an inside portion of the internal lid, the inside portion proximate the hinge.

13. The ice making appliance of claim 9, wherein the float sensor comprises an electrical connection, wherein the electrical connection is disposed between the internal lid and the cover, whereby access to the electrical connection is limited.

14. The ice making appliance of claim 9, wherein the cover may be rotated no less than an angle of one hundred and eighty degrees about the hinge.

15. The ice making appliance of claim 9, wherein the cover rotates about the hinge towards a front side of the ice making appliance, whereby the hinge is positioned between a distal end of the cover and the front side of the ice making appliance.

16. The ice making appliance of claim 9, wherein, when the cover is rotated about the hinge away from the reservoir, the interior volume of the reservoir is exposed and accessible.

* * * * *